US010252899B2

(12) United States Patent
Sauspreischkies et al.

(10) Patent No.: US 10,252,899 B2
(45) Date of Patent: Apr. 9, 2019

(54) METHOD FOR PRODUCING BEVERAGE CONTAINERS AND SYSTEM FOR PRODUCING BEVERAGE CONTAINERS

(71) Applicant: KRONES AG, Neutraubling (DE)

(72) Inventors: Wolfgang Sauspreischkies, Henstedt-Ulzburg (DE); Stephan Mayr, Neutraubling (DE)

(73) Assignee: KRONES AG (DE)

( * ) Notice: Subject to any disclaimer, the term of this patent is extended or adjusted under 35 U.S.C. 154(b) by 564 days.

(21) Appl. No.: 14/442,370

(22) PCT Filed: Nov. 12, 2013

(86) PCT No.: PCT/EP2013/073640
§ 371 (c)(1),
(2) Date: May 12, 2015

(87) PCT Pub. No.: WO2014/072531
PCT Pub. Date: May 15, 2014

(65) Prior Publication Data

US 2016/0272476 A1 Sep. 22, 2016

(30) Foreign Application Priority Data

Nov. 12, 2012 (DE) ..... 10 2012 021 997

(51) Int. Cl.
*B67C 3/00* (2006.01)
*B67C 3/22* (2006.01)
*B67C 7/00* (2006.01)

(52) U.S. Cl.
CPC ..... *B67C 3/007* (2013.01); *B67C 3/22* (2013.01); *B67C 7/00* (2013.01); *B67C 3/001* (2013.01); *B67C 2003/227* (2013.01)

(58) Field of Classification Search
CPC ..... B67C 3/007; B67C 7/00; B67C 7/002; B67C 2003/227; B67C 2007/006; B67C 3/001; B65B 2210/06; B65B 2210/08
(Continued)

(56) References Cited

U.S. PATENT DOCUMENTS 4,936,076 A * 6/1990 Hautemont ..... B65B 59/02 53/64
4,989,392 A * 2/1991 Lindgren et al. ... B65B 2210/06 134/144
(Continued)

FOREIGN PATENT DOCUMENTS

CN 102030119 4/2011 ..... B65B 57/00
CN 102123915 7/2011 ..... B65B 57/00
(Continued)

OTHER PUBLICATIONS

German Search Report issued in corresponding German Patent Appln. No. 10 2012 021 997.0 dated Sep. 25, 2013 (5 pgs).
(Continued)

*Primary Examiner* — Stephen F. Gerrity
(74) *Attorney, Agent, or Firm* — Hayes Soloway PC

(57) ABSTRACT

A method for producing beverage containers includes the steps of:
delivering plastic parisons to a transforming device;
transforming the plastic parisons into plastic containers using the transforming device;
transporting the plastic containers to a filling device;
filling the plastic containers with a liquid using the filling device, and
closing the filled containers with closures. Product changeover from one product to another is facilitated.

11 Claims, 3 Drawing Sheets

(58) Field of Classification Search
USPC .. 53/452, 471, 52, 64, 67, 72, 74, 558, 561, 53/282
See application file for complete search history.

(56) References Cited

U.S. PATENT DOCUMENTS

| | | | | |
|---|---|---|---|---|
| 5,272,853 | A * | 12/1993 | Francioni et al. | B65H 19/10 53/64 |
| 5,424,956 | A * | 6/1995 | Akamaru | B67C 7/00 235/375 |
| 5,524,413 | A * | 6/1996 | Fukuda | B65B 9/20 53/64 |
| 6,079,460 | A * | 6/2000 | Ballan et al. | B67C 3/005 141/145 |
| 6,516,811 | B1 | 2/2003 | Focke et al. | 131/283 |
| 6,973,359 | B2 * | 12/2005 | Holtan et al. | G05B 19/41865 700/100 |
| 7,117,872 | B2 * | 10/2006 | Draghetti et al. | B65B 19/28 131/280 |
| 7,380,386 | B2 * | 6/2008 | Spatafora | B65B 19/28 53/64 |
| 7,620,471 | B2 * | 11/2009 | Li Vigni et al. | B65B 19/32 131/48 |
| 7,684,889 | B2 * | 3/2010 | Focke et al. | B65B 19/228 53/148 |
| 7,874,306 | B2 * | 1/2011 | Wu et al. | B67C 3/001 134/166 C |
| 8,112,969 | B2 * | 2/2012 | Backhaus et al. | B65G 47/5113 53/282 |
| 2002/0095912 | A1 | 7/2002 | Focke et al. | 53/444 |
| 2002/0139436 | A1 * | 10/2002 | Rosen et al. | B67C 3/20 141/86 |
| 2006/0077753 | A1 * | 4/2006 | Markwardt | A23G 3/0002 366/132 |
| 2007/0017593 | A1 * | 1/2007 | Bernhard | B67B 3/26 141/2 |
| 2007/0113919 | A1 * | 5/2007 | Gruson | B67C 3/001 141/91 |
| 2008/0083474 | A1 * | 4/2008 | Mazzon | B67C 3/001 141/6 |
| 2010/0059331 | A1 * | 3/2010 | Finger | B67C 7/002 198/341.09 |
| 2010/0294619 | A1 | 11/2010 | Hahn | 198/368 |
| 2010/0324723 | A1 | 12/2010 | Zech | 700/223 |
| 2011/0061347 | A1 | 3/2011 | Stoiber et al. | 53/558 |
| 2011/0132720 | A1 | 6/2011 | Hasler et al. | 198/341.01 |
| 2011/0277879 | A1 * | 11/2011 | Clusserath | B67C 3/22 141/98 |
| 2013/0231772 | A1 | 9/2013 | Hahn et al. | 700/204 |
| 2013/0309343 | A1 | 11/2013 | Stoiber et al. | 425/169 |
| 2014/0157726 | A1 * | 6/2014 | Clusserath et al. | B65B 3/022 53/452 |

FOREIGN PATENT DOCUMENTS

| | | | |
|---|---|---|---|
| DE | 195 43 945 | 5/1997 | B67C 3/20 |
| DE | 10 2007 062 652 | 6/2009 | B67C 3/24 |
| DE | 10 2008 037 708 | 2/2010 | B65B 57/20 |
| EP | 1 041 006 | 10/2000 | B65B 19/28 |
| EP | 1 225 129 | 7/2002 | B65B 19/28 |
| EP | 2 295 226 | 3/2011 | B29C 49/78 |
| WO | 2005/085069 | 9/2005 | B65B 9/08 |
| WO | 2009/101087 | 8/2009 | B67C 3/00 |
| WO | 2012/016771 | 2/2012 | B65C 9/40 |

OTHER PUBLICATIONS

First Office Action issued in corresponding Chinese Patent Appln. No. 201380058856.8, dated Nov. 26, 2015, with English translation (15 pgs).

* cited by examiner

METHOD FOR PRODUCING BEVERAGE CONTAINERS AND SYSTEM FOR PRODUCING BEVERAGE CONTAINERS

BACKGROUND OF THE INVENTION

The present invention relates to a method and system for producing beverage containers. Such methods and systems have been known for a long time from the prior art. In particular such methods are known in which first of all plastic parisons are transformed into plastic containers and then the plastic containers thus transformed are filled with a liquid and in particular a beverage. In other words, in such methods it is usual for a plurality of components or sub-products are guided relative to one another, such as for example the plastic containers themselves, the closures thereof and the beverage to be bottled.

However, in the event of a product change but also in the event of an end of production often the problem occurs that the residual products must be disposed of and that moreover long switchover times are required. Therefore, methods are also known from the prior art in which such a product change should be made easier. Thus for example DE 10 2008 037708 A1 describes a method for handling beverage containers. In this method a part-quantity of the product located in a feed line is detected in order thus to be able more easily to calculate the quantities still required. The complete content of the disclosure of this publication is hereby incorporated by reference into the subject matter of the present application. In particular the content of paragraphs [0008] to [0030] of this document is made the subject matter of the present disclosure.

In the previous prior art it is left to the operators of an installation when to stop the feeding of the objects for example to a transport device such as a conveyor belt. In this case the experience and the motivation of the operating staff plays a crucial role. A further possibility known from the prior art known is an iterative approach which by trial and error determines the respective numbers which are then stored in a controller. However, this approach must also be carried out in a complex manner for every product which is processed at the customer's site.

If in the prior art the feeding of the respective objects is stopped too early or too late, this leads to stoppage of the plant or to a slowing down due to long emptying times. In addition it is no longer possible to react to different circumstances, such as static charging, pourability, etc., which affect the quantity of components located on the transport equipment. Therefore situations occur more frequently here which are associated with an increased changeover time or with a wasting of product.

Furthermore during the commissioning or after a product change very many open issues have to be dealt with, such as for example the estimation of the number of products located on a transport device.

The object of the present invention therefore is to provide a method and a system in which the transport devices are also run as empty as possible at the end of production or a product change and thus a saving of time is achieved during emptying and restarting.

SUMMARY OF THE INVENTION

In a method according to the invention for producing beverage containers in a first method step plastic parisons are delivered to a transforming device. In a further method step these plastic parisons are transformed into plastic containers by means of this transforming device. In a further method step these plastic containers are transported to a filling device and furthermore the plastic containers are filled with a liquid by means of the filling device, wherein this filling device has a storage container for the liquid to be bottled. Finally the filled containers are closed by means of closures.

Furthermore a product change from first containers to be filled with a first liquid to second containers to be filled with a second liquid is carried out, wherein for the purpose of this product change a desired quantity of the beverage containers to be filled with the first liquid is determined or predetermined and a residual quantity of the liquid to be bottled is determined, in order thus in the context of the product change to facilitate the most extensive consumption possible of the liquid to be bottled, the first containers and/or the first container closures. The desired quantity can be predetermined in this case by a user input, but also by the actual circumstances. Thus it is possible that the desired quantity is predetermined for instance by the residual quantity in a storage container, i.e. production continues until the last liquid tank or syrup tank is empty.

In this case according to the invention the product change can be carried out in such a way that the first liquid to be bottled, the first beverage containers and/or the first container closures are consumed as far as possible.

In particular it can be determined—in particular by the user—whether the first liquid to be bottled, the first beverage containers and/or the first container closures are to be consumed as far as possible.

Therefore in the method according to the invention it is proposed that the respective residual quantities of the liquid, the containers or also the container closures are ascertained. The container closures, the containers and the product to be bottled are also designated below as product components. Thus preferably the quantity of a product component which is still located in the feed paths is determined, for example the quantity of liquid which is located in a supply line between the storage container and the containers to be filled or the quantity of containers which are located on a feed path between the plastic parison feed and the region in which the containers are to be filled with the product.

The changeover times can be reduced overall by at least one of the components being consumed. As mentioned above, in methods known from the prior art disadvantages result for example from the provision of more operating staff which is required during the change of type. In addition, the emptying of the materials which are no longer required is only begun after the end of the production and thus this emptying process can influence the time for the change of type. The availability of the plant drops as a result. The product and material losses will be very different due to the manual interventions of the operator and in each case turn out to be too high.

Furthermore in one aspect of the invention the user should be able to select which product should be consumed as far as possible. In the case of relatively expensive beverages this may for example be the product to be bottled. In the case of other products, such as for example water, it would be possible that it is not the liquid which is completely consumed, but the delivered containers, for example, because these are more valuable than the product to be bottled, and the product to be bottled, in particular water itself for example, can also still be used for a subsequent rinsing operation.

However, it may be pointed out that the invention can also be carried out without the selection by the user as described here and may be distinguished for example by further measures described below which relate for instance to the determination of the residual quantity.

The disadvantages of the prior art can be eliminated by the present invention. A sequence for changing a product should be carried out without an operator so long as no mechanical adjustments have to be made which cannot proceed automatically. As mentioned, on the machines or a control centre the operator can already input in advance which change parameters the respective machines carry out (such as for example the change to a subsequent product, the change of the closures, the selection of rinsing and cleaning operations and the like).

When this selection has taken place, it is conceivable that the system carries out a change of type autonomously, wherein the system can also be controlled here in such a way that the change takes place in a time-optimised manner. In a further advantageous method at least the components which are not completely consumed are discharged before the product change. Thus it is possible for example that the user determines that the liquid itself is consumed as completely as possible. If this has occurred, further components, such as for instance the rest of the containers in which this liquid is to be bottled, plastic parisons which are transformed into the containers, or container closures for these containers are discharged.

In this case the discharge of these components advantageously takes place automatically. Advantageously, as mentioned above, the precise quantities of products in the individual feed paths is determined. Thus for example information on the number of objects, for example containers, located on conveyor belts can be determined. In this case the loading of such transport devices from a feed point up to use thereof, i.e. combining with a further product component, is preferably determined automatically or manually. In this case costly counting or the like can preferably be omitted.

Advantageously after the consumption of the product the machine is stopped and further operations, such as for instance a rinsing operation, a cleaning operation, a sterilising operation or the like are carried out. These operations can also be initiated automatically. In a further advantageous method at least one residual quantity is estimated before the product change. Thus, already long before the actual product change, it is possible for example to estimate how many of the respective product components are still located in the feed path.

Thus for example the quantity of beverage which cannot yet be produced or is already located in the tank and the pipes can be determined long before the end of the production process. At this early stage this already results in a rough, but sufficiently precise estimate of how many containers can still be filled. With this number or estimate the material flows to the consuming machines, that is to say for instance a closer and the transforming device, are then stopped in good time if sufficient material is already on the way.

Thus available silos can then be automatically emptied. At a later time, which preferably however always occurs during the production of the already current or first product, if in particular no more beverage is being produced and thus a precise determination of the quantity of products still available is possible, the precise number of containers still to be filled is preferably determined again.

As a result the quantity which is still technically necessary can be reliably filled.

Alternatively it would also be possible for the determination of the quantity of product to take place continuously from a time at which the quantity still being produced is known. The residues of the excess materials of the product components are preferably voided automatically.

Furthermore it is conceivable that the refilling with a new product is either set by the user himself or it takes place automatically. As mentioned above, the described sequence can preferably be used not only during a change of type but also at the end of production. The above-mentioned further operations, such as rinsing, cleaning or automate mechanical changeover are preferably carried out by the machines without further interventions.

Thus the operator has time remaining for non-automated changeovers or other activities which have to be performed during the change of type. Advantageously the restart for the next production takes place autonomously if all materials and the product are again present.

By the present invention it may be provided that the type change time is independent of the user, since the change of type or product can be carried out without any or with only a few operator interventions. Furthermore the workload of the operating staff is eased and so a quicker type change time is obtained and thus also a higher production and greater availability.

In a further advantageous method, as mentioned above, the delivery of at least one component is stopped before the product change. Thus it would be possible for example to stop the delivery of container closures to the closer as soon as it is established that sufficient closures for the desired quantity of containers are still located in the respective feed lines. The determination of the respective residual quantities of product components can take place in different ways.

As mentioned, at an end of production or at a product change various consumable objects such as for example closure caps or plastic parisons must be changed. As mentioned above, the method according to the invention serves to minimise the times for this change. In order that at the end or change there are not too many objects remaining on the transport devices or delivery devices, as mentioned above the discharge of these objects from a storage container into the transport devices or onto the belts should be stopped in a timely manner. In order to be able to determine this time as exactly as possible, the number of objects on the transport device should be known as precisely as possible. This number can then be compared with the quantity of beverage containers still required which is presupposed as known.

Several possibilities are conceivable for determination of the products still located in the delivery devices or transport devices. In a preferred method at least a percentage running time of at least one transport device which transports such a component is determined. Since the speed of the transport devices is not modified it is conceivable to operate in a start-stop mode. The percentage proportion of running time to total time can be ascertained using a time measuring device, such as for instance a stopwatch, in a predetermined observation time period and is produced by the coefficient between the running time and the total time.

Furthermore the filling time or delivery time is preferably taken into consideration, i.e. the time which the components, such as for example plastic parisons, closures or also the product, need from their respective storage container to the end of the transport, i.e. the point at which it is brought together with the other products. This time can be determined by a pure time measurement and is (depending upon the system output) a fixed system parameter which does not change.

Furthermore the machine output is preferably also taken into consideration, i.e. the output of the machine which processes the objects. This should be constant during the measurement time in which the percentage running time is determined and can be read off directly in the case of modern machines. A commonly used unit is bottles per hour. Therefore the number of components or objects being transported can be calculated using the following equation:

$$\text{number of objects}=(P\cdot t_3)/(3600[s/h]\cdot Lz).$$

A further possibility for determining the number of objects is the quotient of the length of a transport device and the speed of a transport device, for example from a belt length and a belt speed instead of the filling time. If the number of components or piece goods on the transport devices is greater than the number of objects still required, in order to end the production, the conveying of the objects out of the storage container onto the transport device can be stopped. At the end of production there is then ideally still only a small quantity of components present.

As mentioned above, the components are in particular at least in part and preferably totally goods which are delivered piece by piece, but an application to volumes or to delivered liquids would also be conceivable. However, goods which are in particular delivered piece by piece are suitable for the purpose of calculating the quantities. It would also be possible to apply the invention to further fittings of the containers such as for instance the labels thereof. Therefore the containers to be produced are preferably also labelled, which can take place before or also after the filling of the containers. In this case a residual quantity of the labels still to be delivered can be determined. It would also be possible to control a product change in such a way that the respective old labels are consumed as far as possible.

In the event of a further advantageous method a residual quantity of the product component still located in a transport device is determined, as explained in greater detail above.

Furthermore at least a partial quantity of a product component is advantageously taken into consideration as a buffer. This means that a specific number is ascertained, but then advantageously a certain supplement is applied, i.e. in fact a little more product is required.

In this case at the end of production a small quantity which serves as a safety buffer, and by which for example placement errors, breakdowns and the like can be compensated, is then available on the transport devices.

In a further advantageous method parameters which are relevant for the product change are determined during the working operation of the system. In a preferred embodiment movements of the transport devices or of a conveyor belt are generally taken into consideration during control of this transport device. In particular during the respective production the required parameters are recorded and evaluated during a defined time period. In this case in particular the above-mentioned percentage running time can be implemented as a function of the different objects, such as for example containers or container closures or also the product to be bottled.

Advantageously the time period for this determination is at least 3 minutes, preferably at least 5 minutes, particularly preferably at least 10 minutes. In this case the other above-mentioned values can be measured depending upon availability, are acquired from the controller or are input manually and permanently input.

The evaluation for an object can take place a number of times in order to achieve higher precision.

Preferably all results for the quantity of objects on the belt for one type are ascertained, for example by arithmetic means. These mean values can be permanently stored or preferably are determined anew during each production. In this way potentially changed conditions can be dealt with automatically.

In a further advantageous method the delivery of the plastic parisons is not interrupted during a product change. In this way, as explained in greater detail below, jams in the supply lines of the plastic parisons are prevented.

Furthermore the present invention is directed to a system for producing containers which are filled with liquids, this system having a delivery device for delivering from plastic parisons, a transforming device which transforms the plastic parisons into plastic containers, a filling device which is disposed after the transforming device in a transport direction of the plastic containers and which fills the plastic containers with a liquid, as well as a closing device which closes the plastic containers with a closure.

Furthermore the system has a first detecting device in order to determine a quantity of liquid to be bottled which is located in the system, as well as a second detecting device in order to determine a quantity of plastic containers located in the system. Furthermore a desired quantity of filled containers to be produced can be predetermined.

According to the invention a processor device is provided which is configured in such a way that it initiates and/or controls a product change or an end of production in accordance with the results which are output by the first and the second detecting devices, as well as also containers which are to be filled in accordance with the desired quantity. This processor device may be a separate device or may preferably be integrated into the machine control system.

It is therefore proposed in terms of the system that likewise the residual quantity of the product still to be bottled is detected, in particular also taking into account product located in the filling lines as well as the quantity of containers, wherein here too in particular a quantity of containers present in the feed paths or transport devices is also taken into consideration. In this way, as mentioned above, the consumption of product can also be reduced. In particular in this way the changeover times necessary for a product change or for a product can also be reduced.

In this case the detecting devices may be components such as counters. However, it would also be possible that the detecting devices determine the respective quantities, as explained above, with reference to other machine parameters, such as for instance the production speed. Thus the detecting devices may also be stored purely as software in the machine controller. Thus a detecting device is preferably a device which is capable of determining a respective quantity of a component. This determination may be both a precise determination of the number of items or residual quantity and also an estimate.

In a further advantageous embodiment a detecting device is also present in order to ascertain a quantity of container closures located in the system. The respective feed paths are preferably also taken into consideration here.

In an advantageous embodiment, within the context of a product change or a stoppage of production it can be determined by the user whether the liquid to be bottled, the beverage containers or the container closures are to be consumed as far as possible. In this embodiment, therefore, it is also proposed in terms of the system that the user can predetermine which product should if possible be largely consumed, in order for example to use the most valuable product as efficiently as possible.

In a further advantageous embodiment the transforming device is a stretch blow moulding machine. This preferably has a movable and in particular a rotatable carrier on which a plurality of transforming stations is disposed. These transforming stations preferably each have blow moulds, inside which the plastic parisons are expanded to form the plastic containers. The system advantageously also has transport devices which for example transport the finished blow moulded containers to the filling device. In this case a number of containers within these transport devices can advantageously be set or predetermined. These transport devices preferably transport the containers at least partially and preferably completely separately.

In the prior art on occasions the problem arises that during filling of a still empty plastic parison channel before the blow moulding machine the plastic parisons become stuck and then have to be set in motion again manually. Usually in the prior art this plastic parison channel is run empty during changing of the plastic parisons, so that during the refilling plastic parisons become stuck and sometimes a manual intervention is necessary.

Thus in a further embodiment of the above method it is proposed that the delivery device for delivering the plastic parisons to the transforming device (the transforming device being understood here in particular to include a preceding oven for heating the plastic parisons), the delivery is not interrupted but the plastic parisons are transported seamlessly, i.e. the last "old" plastic parison (of the first product) is followed directly by the first new plastic parison, i.e. the plastic parison which serves for the new product.

In other words during changing of the plastic parisons the channel is not run empty. In this way the old plastic parisons serve as a support for the new plastic parisons. The old plastic parisons are automatically discharged in the channel before the oven of the transforming device when they bring the new plastic parisons to the blow moulding machine. Thus the system advantageously has a discharge point for discharging the plastic parisons. This is preferably disposed before the heating device for heating the plastic parisons or in any case before the transforming device for transforming the plastic parisons into plastic containers.

Advantageously the system also has a sorting device for sorting the plastic parisons, such as for example a so-called roller sorter. In this case a counting register is advantageously provided in the transforming device—after the roller sorter—by means of which the plastic parisons can be counted and by means of which in particular the old plastic parisons which are to be changed can be counted. This counting register can for example be implemented by the feed starwheel on the blow moulding machine.

Advantageously at a change of plastic parison or in particular for the new filling by means of a counting register the roller sorter or the sorting device is run empty and the excess plastic parisons still located in the transport device are advantageously discharged before the roller sorter. If the new plastic parisons are now conveyed in the roller sorter, then they are supported on the old plastic parisons located in the channel. As mentioned, the old plastic parisons are discharged via a counting register. This embodiment offers the advantage that a fully automatic change of the plastic parisons is always possible. For the process of running empty, however, counting can be omitted, it is possible here that the corresponding provisions are determined by means of sensors and time frames.

The system preferably has at least one discharging device for discharging at least one product component, wherein this discharging device is still disposed before a region in which this product component is brought together with a further product component, for example joined thereto. The system preferably has a plurality of such discharging devices and in particular in each case at least one discharging device for each product component. In a further advantageous embodiment, for one product component a plurality of discharging devices are provided which are disposed one behind the other in a direction of movement of this product component, for instance two or more discharging devices for discharging plastic parisons.

BRIEF DESCRIPTION OF THE DRAWINGS

Further advantages and embodiments are apparent from the appended drawings.

In the drawings.

DETAILED DESCRIPTION OF THE INVENTION

Figure 1:
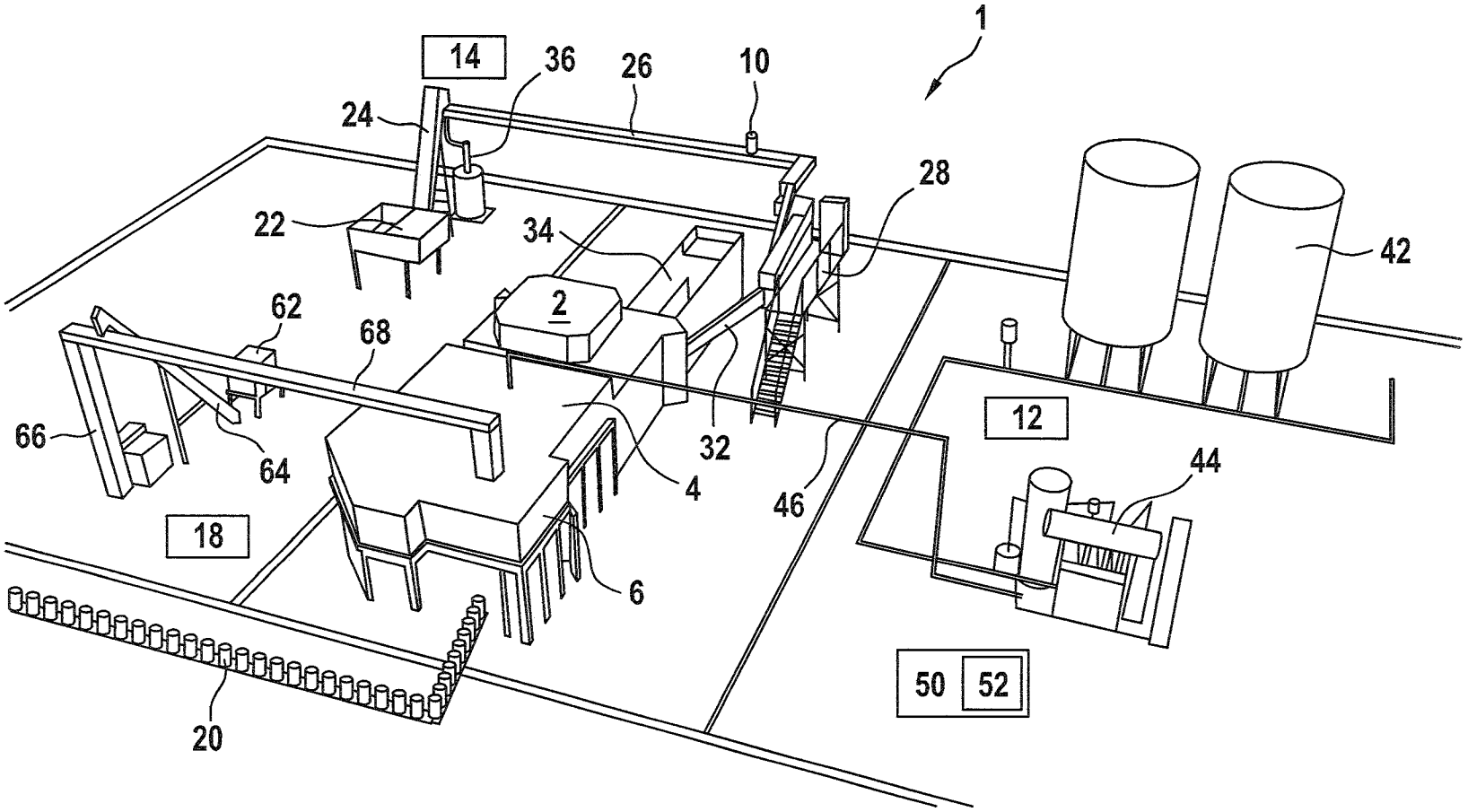
FIG. 1 shows a schematic representation of a system according to the invention.

FIG. 1 shows a view of an arrangement 1 according to the invention for producing beverage containers 20. In this case this system has as system parts a transforming device 2, by means of which plastic parisons are transformed into plastic containers, a filling device 4 as well as a closing device 6.

The reference numeral 22 relates to a storage device for plastic parisons and the reference numeral 24 relates to a conveying device for conveying the plastic parisons. The reference numeral 10 relates to a plastic parison (only illustrated schematically and not with exact details) which is delivered via a transport route 26 and a delivery channel 32 initially to an oven 34 and then to the actual transforming device 2. The reference numeral 36 identifies a first discharging device for discharging plastic parisons. The reference numeral 28 relates to a second discharging device (which is, however, concealed) for discharging plastic parisons, in particular preceding a changeover process.

The product to be bottled, or in this case a syrup which is mixed to produce the beverage, is stored in storage containers 42 and initially reaches a mixing device 44. From there the product to be bottled passes via a supply line 46 into the filling device 4 designated as a whole by 4. The containers filled in this way are transferred further to a closer device 6 and the containers 20 are closed by means of this closer device.

The reference numeral 62 relates to a storage device for closures, the reference numeral 64 relates to a first conveying device, such as for instance an inclined conveyor, and the reference numeral 68 relates to a further transport device which conveys the closures to the closer 6. The reference numeral 66 identifies a discharge path for discharging the plastic parisons. Within the context of the present invention discharge paths or discharge devices are understood to be those devices which discharge a specific product component before the point where it is joined together with other product components from the system.

The reference numeral 12 relates to a first detecting device (only illustrated schematically) which serves to detect a quantity of the product to be bottled in the respective supply lines 46. The reference numeral 14 identifies a second detecting device which detects the quantity of containers located in the system. In this case it is possible to detect both the number of plastic parisons 10 and also the number of containers or plastic parisons which are for example located in the oven 34 or in the transforming device 2 itself.

The reference numeral 18 designates a third detecting device (likewise only illustrated schematically) which detects the number of container closures in the transport system 64 and 68.

If a product change is carried out, these individual detected numbers are co-ordinated with one another in such a way that it is possible for example for the product still located in the lines to be completely consumed and to make the necessary number of containers and container closures available for this purpose. Then excess containers or in particular plastic parisons are in each case discharged by the discharging devices 36 and 28.

The reference numeral 50 designates a control device, which in particular control this product change, wherein this control device can also in particular take into consideration the respective values determined by the detecting devices. In this case this control device can communicate with the individual detecting devices, wherein it would also be conceivable for these detecting devices to be integrated into the controller. The control device also has a processor device 52 which controls the product change of the system as a function of the respectively detected or ascertained quantities. As mentioned, the individual detecting devices may also be contained in the machine controller.

The second discharging device 28 for the plastic parisons serves in particular so that the plastic parison channel 32 does not have to be run completely empty, but, as described above, the "old" plastic parisons can be followed directly by the "new" plastic parisons. Therefore between the plastic parison channel 32 and the oven a further discharge (not shown) is provided in order to be able to discharge remaining old plastic parisons after a product change.

Figure 2:
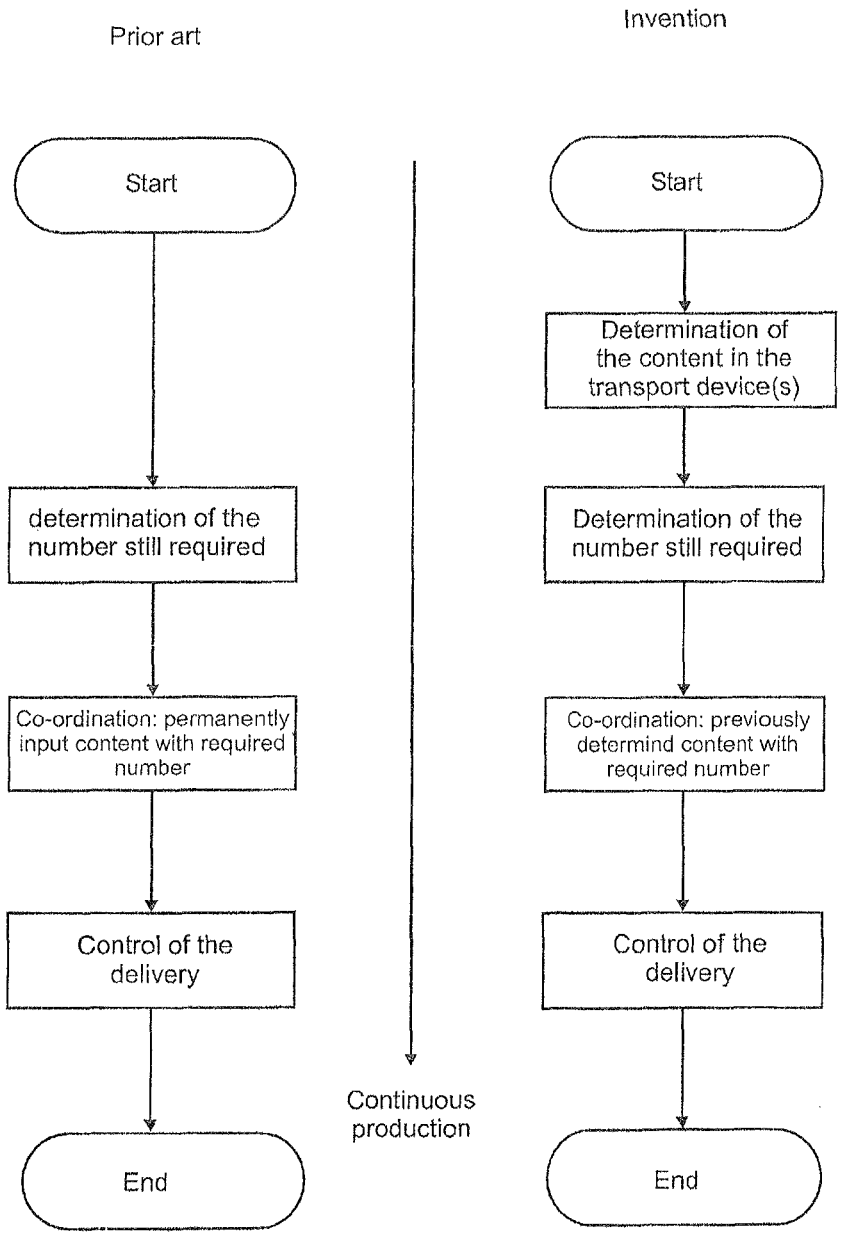
FIG. 2 shows two flow diagrams for illustrating the method according to the invention.

FIG. 2 shows a comparison between a method according to the prior art (left-hand side) and a method according to the invention.

In this case, both in the prior art and also in the method according to the invention, the number of containers still required is determined or predetermined (for instance by a user input). In the prior art, however, a permanently input content (or a specified number of product components still located in the transport devices) is compared with the required number and accordingly the change is carried out.

Additionally within the context of the invention it is proposed that the content is also determined on the transport, i.e. in particular the number of containers or of closures or also of the product. Thus in the case of the invention a co-ordination of the content with the required number takes place, instead of the predetermined content in the prior art. In this case the method step shown here of determining the content can be repeated for a plurality of product components and, as illustrated, can also be carried out during the current production system.

Figure 3A:
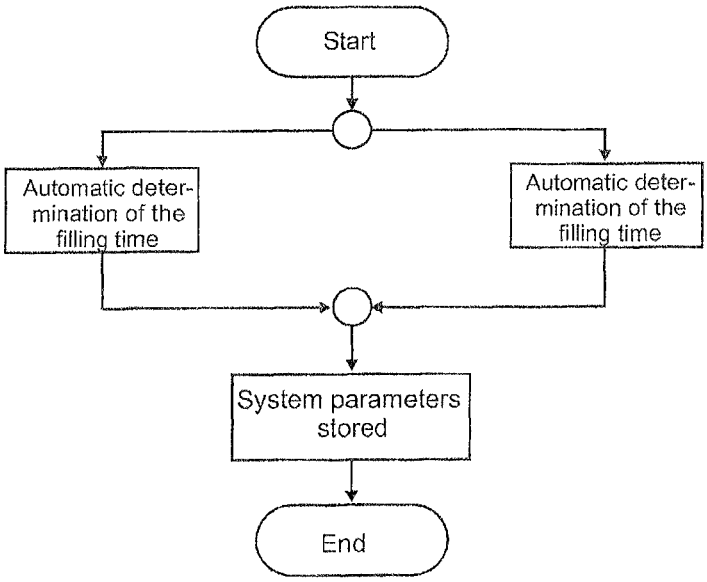
FIGS. 3*a*, 3*b* show two flow diagrams for illustrating the determination of the products located in the delivery device.

FIG. 3*a* shows a representation for illustrating the determination of the content. In this case it is conceivable that either the filling time is determined manually or is determined automatically. This value is in turn output and the system parameters relating to the filling time are stored.

Furthermore the quantity in the respective filling lines can in turn be determined, and the corresponding values are then stored. This quantity can be determined for example by means of flow meters and/or taking into account a diameter as well as a length of the respective lines. This method for determining the content is preferably only carried out once, for instance during the configuration and/or commissioning of the system.

Figure 3B:
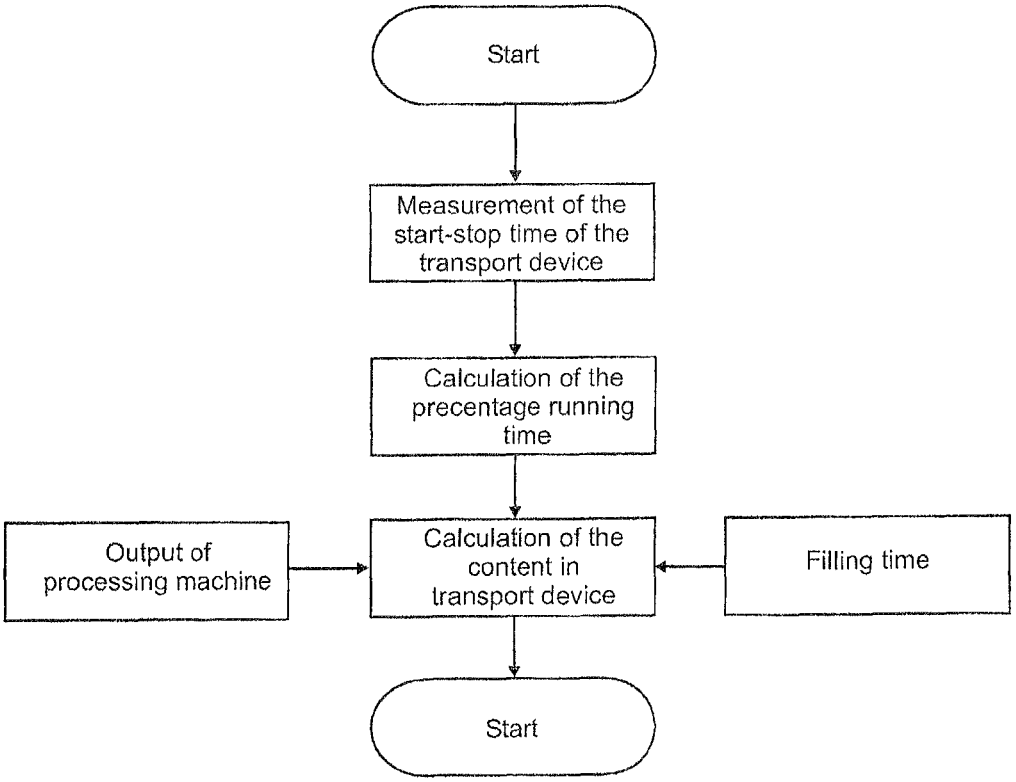

Furthermore it is also conceivable (cf. FIG. 3*b*) that during each production process the respective measurements are carried out. In this case the start/stop time of the transport devices or transport belts are determined and then, as stated above, the percentage running time can be determined. Thus with further use of the output of the processing machine as a basis, the content can also be determined in the transport device, for example the number of closures or containers or also of the product. If now, additionally, the filling time illustrated above is taken into consideration, in this way it is possible to determine precisely when precisely the change can be carried out. Also the system can initiate a changing operation as a function of the results thus determined.

The applicant reserves the right to claim all the features disclosed in the application documents as essential to the invention in so far as they are individually or in combination novel over the prior art.

LIST OF REFERENCE NUMERALS

1 arrangement
2 transforming device
4 filling device
6 closing device
10 plastic parison
12 detecting device
14 detecting device
18 detecting device
20 beverage containers
22 storage device
24 conveying device
26 transport path
32 plastic parison channel
28 second discharging device
32 delivery channel
34 oven
36 second discharging device
42 storage container
44 mixing device
46 supply line
50 control device
52 processor device
62 storage device
64 conveying device
66 discharge path
68 further transport device

The invention claimed is:

1. A production method for producing beverage containers filled with a liquid in a production system comprising the steps of:

delivering plastic parisons to a transforming device;

transforming the plastic parisons into plastic containers using the transforming device;

transporting the plastic containers to a filling device using a transport device;

filling the plastic containers with a first liquid using the filling device, wherein the filling device has a storage container for the first liquid; and closing the filled containers with closures;

wherein a product change from first containers to be filled with the first liquid to second containers to be filled with a second liquid is carried out, and wherein in order to effect the product change, a desired quantity of the first containers filled with the first liquid is determined and a residual quantity of the first liquid is determined, wherein when one of the first liquid, the first containers or first container closures is consumed, then the first liquid, the first containers and the first container closures which are not completely consumed are discharged from the production system before the product change, the production method is altered and whereupon the filling device is subjected to a rinsing operation and/or a cleaning operation and/or a sterilising operation, and wherein the delivery of the plastic parisons to the transforming device is continued without interruption during the product change.

2. The method according to claim 1, including the step of estimating at least a residual quantity of the plastic parisons, first plastic containers, first container closures or the first liquid before the product change.

3. The method according to claim 1, wherein delivery of at least the first containers, the first container closures or the first liquid is stopped before the product change.

4. The method according to claim 1, wherein at least a percentage running time of the transport device or the filling device is determined at a time of product change.

5. The method according to claim 1, wherein a residual quantity of the first containers or first liquid still located in the transport device or filling device, respectively, is determined at a time of product change.

6. The method according to claim 1, wherein at least a quantity of the plastic parisons, the first containers, first container closures and the first liquid is taken into consideration as a buffer at a time of product change.

7. The method according to claim 1, wherein the product change is commenced during said delivering, transforming, transporting, filling and said closing steps.

8. The method according to claim 1, wherein upon a determination that the first liquid is completely consumed any remaining unfilled first containers or closures for the first containers are discharged from the production system.

9. The method according to claim 1, wherein the rinsing operation, the cleaning operation and/or the sterilizing operation is initiated automatically.

10. The method according to claim 1, wherein the product change includes a change to new plastic parisons.

11. A production system for producing beverage containers filled with liquids, said production system including a delivery device for delivering plastic parisons, a transforming device for transforming the plastic parisons into first plastic containers, a filling device disposed after the transforming device in a transport direction of the plastic containers for filling the first plastic containers with a first liquid, and a closure device which closes the first plastic containers with a closure, wherein the system has a first detecting device for detecting a quantity of the first liquid which is located in the system and for sending a first signal to a processing device, as well as a second detecting device for detecting a quantity of the first plastic containers located in the system and for sending a second signal to the processing device, and wherein a quantity of filled first containers capable of being produced by said first and second detected quantities is calculated by the processing device, wherein the processing device controls a product change on a basis of the first and second signal outputs by the first and second detecting devices as well as the calculation of the quantity of containers capable of being produced, wherein in an event of a product change or a production quantity fulfilment a determination is made whether the first liquid, the plastic parisons, the first plastic containers and container closures are fully consumed, wherein when the calculation determines full consumption of the first liquid to be bottled, the first beverage containers or container closures, the production system is altered and whereupon a rinsing operation and/or a cleaning operation and/or a sterilising operation is conducted, and wherein in the delivery device, the delivery of the plastic parisons is continued without interruption during the product change or the production quantity fulfilment.

* * * * *